United States Patent [19]

Besson

[11] Patent Number: 4,600,316

[45] Date of Patent: Jul. 15, 1986

[54] WATCH HAVING AN ANALOG AND DIGITAL DISPLAY

[75] Inventor: René Besson, Neuchâtel, Switzerland

[73] Assignee: ETA SA Fabriques d'Ebauches, Switzerland

[21] Appl. No.: 659,265

[22] Filed: Oct. 10, 1984

[30] Foreign Application Priority Data

Oct. 25, 1983 [CH] Switzerland ..... 5772/83

[51] Int. Cl.[4] ..... G04C 9/00

[52] U.S. Cl. ..... 368/187

[58] Field of Search ..... 368/184–189, 368/190

[56] References Cited

U.S. PATENT DOCUMENTS 4,419,018 12/1983 Meyrat ..... 368/187

FOREIGN PATENT DOCUMENTS 2642733 9/1980 United Kingdom .

2071364 9/1981 United Kingdom ..... 368/185

*Primary Examiner*—Bernard Roskoski

[57] ABSTRACT

The invention provides an electronic watch having an analog display with time indicating hands, a digital display and control means including a crown adapted to act on contacts arranged so as to provide signals representing rotary and axial displacements of said crown to an electronic selection and correction circuit.

Responding to movements of the crown, the electronic circuit determines the operating mode of the watch and modifies the indications given by the displays. In a special synchronizing mode the two displays are set to indicate the same information and the analog form thereof may be adjusted to coincide with the digital form.

6 Claims, 12 Drawing Figures

WATCH HAVING AN ANALOG AND DIGITAL DISPLAY

This invention concerns electronic watches having both analog and digital displays and provided with means for synchronizing such displays when they are both indicating the same time information.

BACKGROUND OF THE INVENTION

The simultaneous use of an analog display by means of time indicating hands or discs and of a digital display within a watch has rapidly expanded over recent years. This type of watch effectively provides the advantage of enabling reading the time in an easy and conventional manner with the time indicating hands and permitting access to numerous auxiliary functions such as the day, date, alarm time, time zones, ect. on the digital display.

For certain functions the information items of the two displays are different and independent as for instance the time read on the analog display and a chronograph or measured time indicated on the digital display. For other functions both displays may give the same information items which depend on one another. For example, the day and the data read on the digital display must be related to the time of the analog dispaly in order that the calendar may change its state when the hands indicate midnight. Among the various functions of the watch, one function must thus enable one to read and correct the time indicated by the hands independently from the time indicated on the digital display or inversely. Even if this information is not explicitly employed, it is necessary for the calendar function as well as, for example, for the time zone function.

When the same information item is indicated on both displays, the time for instance, there must thus exist display synchronization or phasing means, so as to enable to have appear in this type of watch the same time on the analog and digital display. This operation is necessary at the time when the watch is first put into service and each time when the battery is changed.

Two types of watches provided with analog and digital displays are for instance described in the U.S. Pat. No. 4,246,602. In the first version the analog display is corrected mechanically by means of a crown, independently from the digital display which continues to receive time signals. This manner of operation is at the least imprecise because of the play in the gearing, necessitates a clumsy and expensive mechanism and prevents use of the crown for functions other than that described. In the second version the analog display is stopped by means of a switch and it is the digital display which is corrected with the help of contacts until there is coincidence between both indications. The watch in this case does not have a crown. An exact synchronization may be obtained with an analog hour display, the minutes advancing by integral units. On the other hand, if the minutes hand advances by fractions of a minute as is most often the case, the exactness of the synchronization cannot be guaranteed and one arrives back at the first difficulty of the initial version.

The British laid open patent application GB No. 2 019 052, on the other hand, described a watch having a mixed analog-digital display provided with a crown enabling electronic correction backwards and forwards of both displays by integral minute steps. This is an interesting solution since it approaches the usual type of well accepted control employed in mechanical watches.

The watch described presents however the disadvantage of requiring in addition to the crown further control mechanisms and to lack means which permit synchronizing the displays.

SUMMARY OF THE INVENTION

To avoid the foregoing difficulties the present invention provides an electronic watch comprising:

a time base arranged to provide a standard frequency signal;

a divider circuit arranged to divide said standard frequency signal;

indicating means arranged to display a first group of time information items in analog form;

a stepping motor mechanically coupled to said indicating means;

a control circuit arranged to supply drive pulses to the motor so as to effect displacement of said indicating means in response to time pulses provided by the divider circuit as well as to correcting pulses;

a counting circuit likewise receiving time pulses from the divider circuit thereby to provide signals representing a second group of time information items of which at least one information item is includes in said first group;

an electro-optic display coupled to said counting circuit in order to display the second group of time information in digital form;

manual control means; and a selecting and correcting logic circuit responsive to operation of said manual control means thereby to place the watch in different display modes for each of which a selected time information is displayed by said electroptic display means and in different correction modes for each of which a displayed information item may be corrected through application by said logic circuit of correcting pulses to the counting circuit, said logic circuit likewise applying correcting pulses to the motor control circuit whenever the information to be corrected is that common to both groups and in a manner to modify the analog and digital indications of said common information by the same quantity, said logic circuit being adapted to enable placing the watch in a supplementary synchronisation mode in which said common information is displayed by said electrooptic digital display and in which said logic circuit responds to an operation of the manual control means by applying correcting pulses only to the motor control circuit in order to enable bringing the analog indication into coincidence with the digital indication of said information.

It is evident that in most cases a watch in accordance with this invention will comprise at least one indicating means for minutes and one for hours, these two information items being likewise capable of being displayed in digital form and wherein synchronisation can be effected at least for the minutes indication.

Moreover, the watch preferably will be provided with a bi-directional stepping motor and counting means capable of up and down counting in order to enable modification of time information of both groups in both directions.

DESCRIPTION OF THE PREFERRED EMBODIMENT

Figure 1:
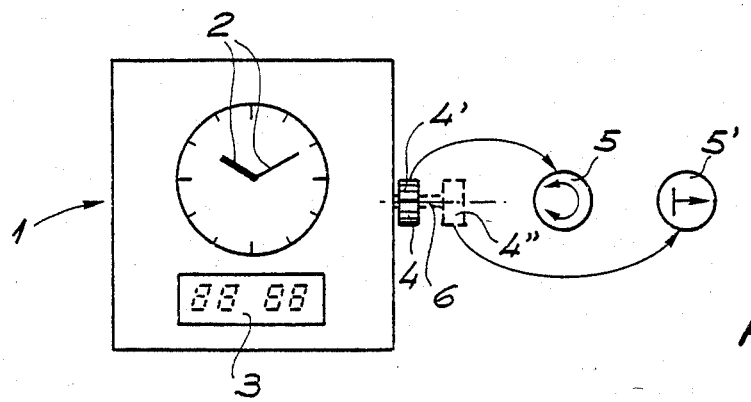
FIG. 1 shows a view of a watch provided with an analog display with time indicating hands, a digital display and a controlling crown.

On FIG. 1 is shown an example of a watch 1 according to the present invention. This watch comprises an analog display having two hands 2, a digital display 3 with four characters and a control crown 4 capable of moving with two degrees of freedom.

One of the hands 2 of the analog display indicates hours and the other minutes. The minutes hand advances by fractions of a minute. To simplify the description it will be supposed that it advances every 30 seconds, generalization to other possibilities being evident. Time setting of the analog display 2 is obtained electronically be means of crown 4 and may be backwards or forwards by the utilization of a bidirectional motor.

In the example shown, the digital display 3 indicates either the day and the date or hours and minutes or it may remain blank in a synchronization position, but the present invention is not limited to just these functions. The two characters at the left of the display 3 may display both digits and letters necessary for the indication of days of the week. The two characters at the right permit display of digits only. The selection of operating modes of the watch and the corrections of the digital display 3 up or down are both obtained by means of crown 4.

The two positions and two degrees of freedom of crown 4 are represented on FIG. 1. The reference 4'shows the crown in its normal pushed-in axial position. Pulling out the crown causes it to pass to drawn out position 4". Position 4" is unstable since a return bias spring permanently urges the crown to its normal position 4'. Whatever the axial position of the crown may be, it may be turned in both senses about axis 6. The rotation corresponds to the first degree of freedom and pulling out the crown to the second degree of freedom thereof. These two degrees of freedom are respectively represented by symbols 5 and 5' on FIG. 1.

Figure 2A:
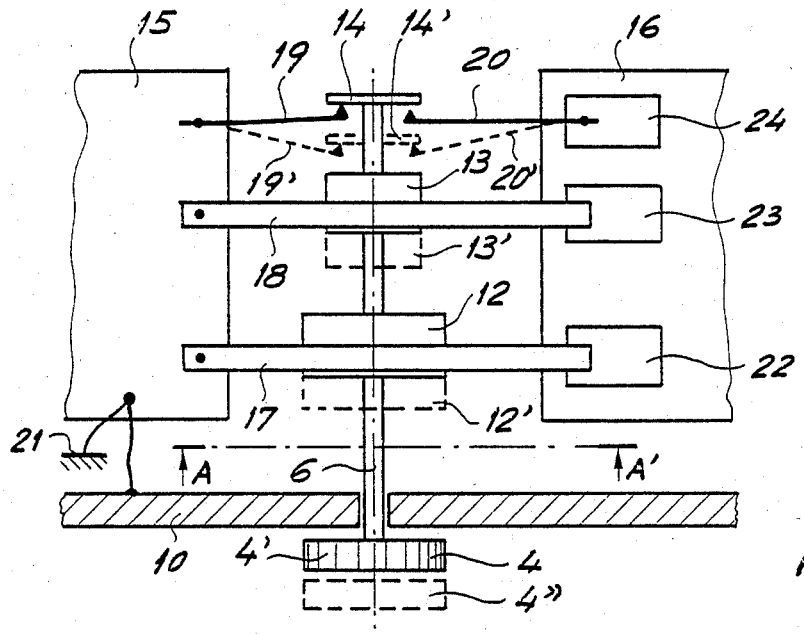
FIGS. 2*a* and 2*b* show a plan view and an end view of one example of a mechanism for operating the contacts which detect movements of the crown.
Figure 2B:
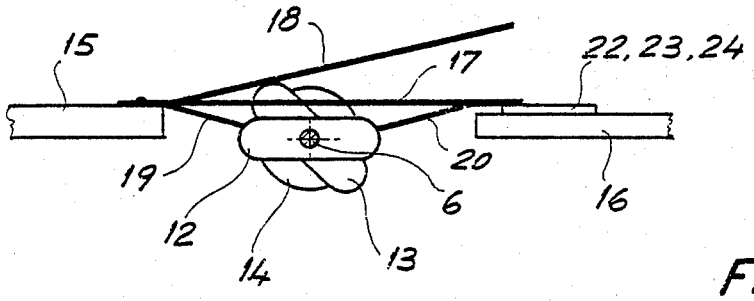

Crown 4 controls a mechanism shown in plan view on FIG. 2*a* and in an end section taken from lines AA' on FIG. 2*b*. This mechanism operates contacts for detecting the movements of the crown. One may distinguish on FIG. 2*a* the crown 4 fixed to one end of axis 6. This axis traverses wall 10 of a watch case, such being connected to an electric ground point 21. On axis 6 are fixed two cams 12 and 13 of insulating material and of elongated form e.g. elliptical form. The major axis of the ellipses form between them an angle on the order of 45°. At the other end of axis 6 is fixed a metallic disc 14. In the drawn out position 4" of the crown cams 12, 13 and the disc 14 are blocked into position respectively 12', 13' and 14'. Three contact blades referenced 17, 18 and 19 are fastened by one of their respective ends to a metal plate 15 electrically coupled to the ground point 21 and fixed to the watch case. Blades 17 and 18 may each move in a plane perpendicular to the axis 6 and the blade 19 in a plane parallel to the same axis. The rotation of cams 12 and 13 by crown 4 effects displacement of blades 17 and 18. The cams moreover are of a width sufficient to act in the same manner in a drawn out or pushed in position of the crown. Blade 19 is biased in a manner to be in permanent contact with disc 14 and connects this with the electric ground while providing a return force on the axis 6 tending to maintain the crown in the normal pushed-in position 4'. Three conducting plates referenced 22, 23 and 24 are fixed to an insulating plate 16 secured to the watch case. In the rest or non-deformed position, the contact blades 17 and 18 by their other extremity contact respectively plates 22 and 23. A blade and the corresponding plate form thus a contact which will bear the reference of the blade. The rotation of cams 12 and 13 provoking a displacement of the blades, has as consequence to open and shut contacts 17 and 18. By rotation of 360° of the crown 4 each contact will be brought into play twice. The angular spread between cams 12 and 13 has as effect to cause a phase displacement in the operation of contacts 17 and 18. This phase displacement is different according to the rotation sense of the cams, and thus of crown 4. It constitutes thus a parameter representing the first degree of freedom of the crown. The frequency of operation of contacts 17 and 18 enables measuring the speed of rotation of the crown of which the angle of rotation is determined by the number of closings of the contacts.

On metallic plate 24 is fastened a blade 20 capable of being displaced in the same plane as blade 19. In the pushed-in position 4' of the crown blade 20 remains free. In the drawn-out position 4" of the crown disc 14 is brought into position 14'. It thereby displaces blades 19 and 20 respectively into positions 19' and 20'. In this position of the crown disc 14 contacts blade 20. The assembly constitutes a contact which will be designated by reference 20. The state of this contact constitutes thus a paramenter representative of the second degree of freedom of crown 4.

The functions that a watch is capable of indicating and the possibilities of correction of the displayed information define the operational modes of the watch. The passage from one mode to another is brought about through the control means of the watch.

Figure 3:
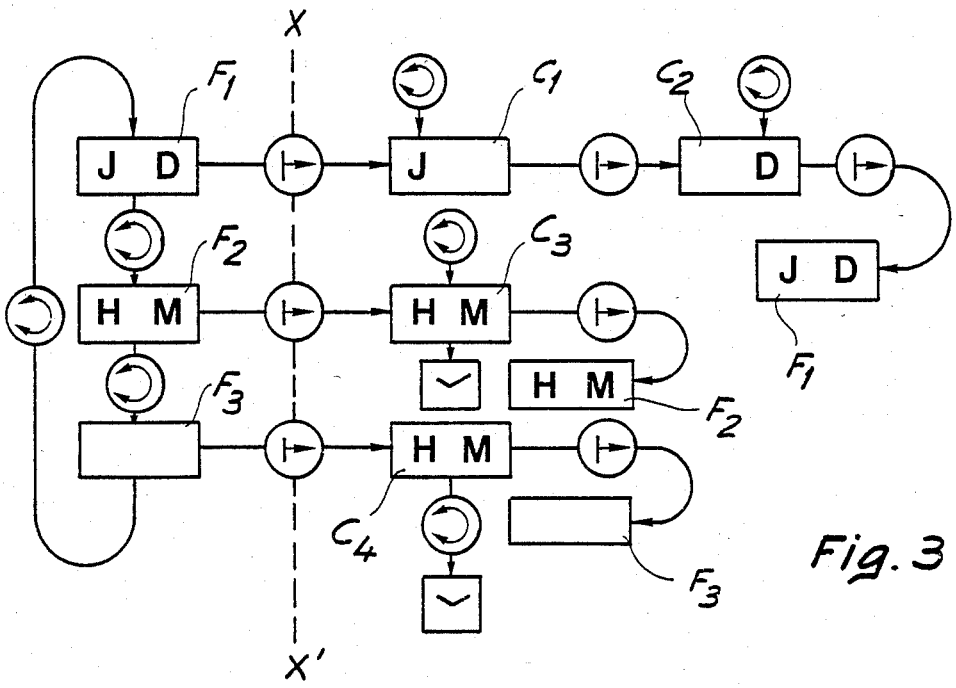
FIG. 3 is a diagram showing different modes of operation of the watch.

FIG. 3 represents the different modes in which the watch according to the example may be placed. On this figure the rectangles indicate the information items appearing on the digital display and the circles symbolize the controls. A line XX' divides FIG. 3 in two portions. On the left side of this line are grouped functions $F_1$, $F_2$ and $F_3$ of the watch and on the right side the corrections $C_1$, $C_2$, $C_3$ and $C_4$. A square symbolizing the analog display, is equally shown in association with the corrections which may influence it. The watch may thus operate in seven diffent modes. $F_1$ corresponds to the calendar function, the day J appearing on the two characters to the left and the date D on the two digits to the right of the digital display 3. $F_2$ corresponds to the watch function, the hours H being displayed to the left and the minutes M to the right. Finally, in $F_3$ is to be found the function of synchronisation of the analog display with the digital display. In this mode and in the example chosen the digital display indicates no information for showing up the analog display. The passage from one function to another is effected in a predetermined order so as to simplify the circuits by turning the crown 4 in one sense or in the other but the order of presentation of the functions may evidently be made to depend on the rotation sense of the crown.

The passage from a function to the corresponding correction mode is obtained by drawing out the crown 4 followed by releasing thereof as shown on FIG. 3. This operation thus permits the changeover from function $F_1$ to the correction mode $C_1$. In this mode only the two characters to the left will appear, indicating a week day. A rotation of the crown thereafter permits changing of said week day by causing the days to appear successively one after the other. The order of passage of the days depends on the rotation sense of the crown in order to enable a rapid correction. The passage from mode $C_1$ to the following correction mode $C_2$ is likewise obtained by drawing out and releasing the crown. Only the two digits to the right will then appear indicating the date which may be corrected by a rotation of the crown 4. According to the rotation sense the number corresponding to te date may be incremented or decremented. Finally, a further drawing out on the crown brings the watch back to its starting mode $F_1$. In a like manner, starting from function $F_2$ one may pass to the correction mode $C_3$ in which the digital display 3 indicates simultaneously hours H and minutes M. To distinguish mode $F_2$ from the mode $C_3$ one may, for instance, cause blinking of the hours and minutes in the correction mode in synchronism by known means. The time pulses are blocked in the mode $C_3$ and the seconds counter of the watch circuit is returned to zero. The rotation of crown 4 then permits correcting the time indications, hours and minutes by integral minute steps simultaneously on digital display 3 and analog display 2 by the same amount. According to the sense of rotation of the crown, the correction will advance or turn back the watch. An exact time setting may thus be made in mode $C_3$ since the watch is stopped on an exact minute. If both displays do not indicate the same hour, for instance following a battery change, it is the digital display 3 which must be set to the exact hour. The return to the function $F_2$ is finally obtained by drawing out and releasing crown 4.

At this stage the digital display 3 is at the exact hour but the analog display 2 may possibly be misaligned by an integral number of minutes. In this case it is necessary to pass to the synchronisation function $F_3$ then, by drawing out crown 4, to the correction mode $C_4$. In this mode the time pulses are not blocked, but they control only the digital display 3 which continues to indicate the exact hour H, M, while the hands 2 of the analog display rest blocked. In order to distinguish modes $F_2$, $C_3$ from the mode $C_4$, all these modes indicating hours and minutes, one may for instance cause H and M in mode $C_4$ to blink alternately by known means. In mode $C_4$ the rotation of crown 4 in one sense or in the other has as effect to cause to advance or return the hands 2 by stepping entire minutes, the number of steps being proportional to the rotation angle. This operation permits putting the two displays in synchronism or in phase by having them indicate the same time information. Drawing out crown 4 once again then causes the watch to return to mode $F_3$ and thereafter a rotation of the crown permits passing to the normal operating mode $F_1$. In order to simplify the various manipulations the return to function $F_1$ could equally be effected automatically at the end of a certain delay period, for instance 16 seconds following the last operation in any mode of correction whatsoever.

Figure 4:
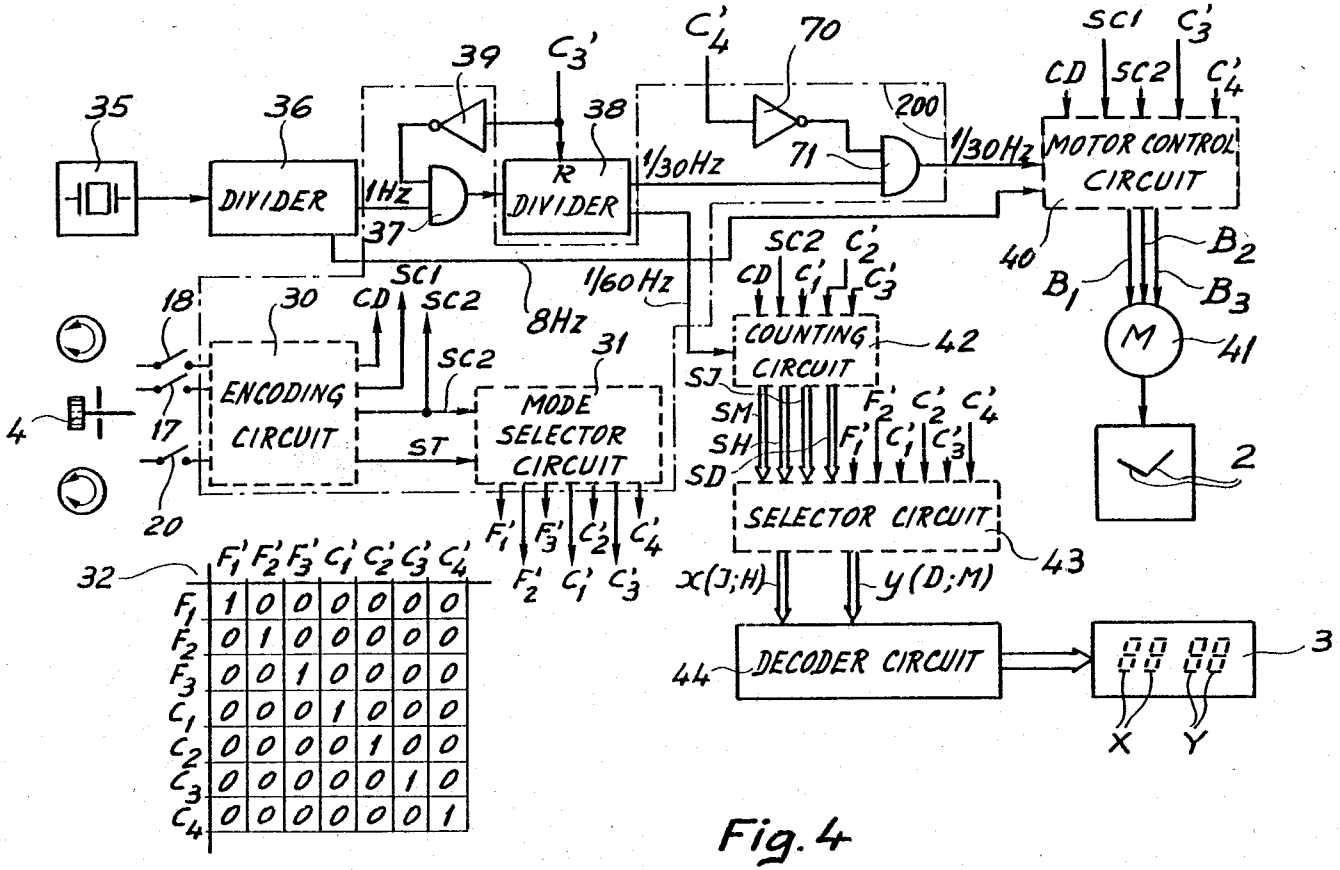
FIG. 4 shows an example of a block schematic drawing of the watch circuit.

The schematic block diagram of a watch in accordance with the invention is shown on FIG. 4. The blocks drawn in full line on this figure represent known circuits and those drawn in dotted line circuits having specific functions necessary to the present invention. These latter circuits will be described in detail hereinafter. All circuits are energized by means of a battery not shown.

The block schematic of FIG. 4 comprises an encoding circuit 30 of the movements of the crown 4. A first and second input to the circuit 30 receives respectively signals coming from contacts 17 and 18 represented on FIGS. 2*a* and 2*b*. These signals enable defining the sense of rotation of the crown. The signal generated by contact 20 of FIG. 2 responsive to drawing out crown 4 is applied to a third input of circuit 30. This circuit develops, as a function of the input signals, coded output signals CD, SC1, SC2 and ST, representing the movements of the crown according to the two degrees of freedom. The signal CD is a logic signal which is at a low level for one sense of rotation of the crown and at a high logic level for the other sense of rotation. Signal SC1 incorporates a number of pulses proportional to the rotation angle of the crown, whatever might be the sense of rotation. Signal SC2 is obtained from signal SC1 by suppressing one pulse out of two. Finally, signal ST contains one pulse for each withdrawal of the crown, the release of the latter not producing any effect.

Output signals SC2 and ST of circuit 30 are applied to the inputs of a mode selector circuit 31 providing at its output logic signals $F'_1$, $F'_2$, $F'_3$, $C'_1$, $C'_2$, $C'_3$, $C'_4$. These output signals enable definition of seven different states corresponding to the seven modes in which the watch may be placed. A specific case of correspondence between the mode and the logic state of the signals is represented on table 32 of FIG. 4. One may see that in this example, to each mode there corresponds a high logic level of an output signal, the other signals remaining at the low level. To the mode $F_1$ corresponds thus a high logic level solely of the signal $F'_1$; in the same manner to the mode $F_2$ corresponds a high logic level of the signal $F'_2$ . . . etc. and to the mode $C_4$ corresponds a high logic level of the signal $C'_4$.

Circuits 30 and 31 form the selection portion of the schematic of FIG. 4. The timing portion of this schematic includes a quartz oscillator 35 providing at its output a standard reference signal of 32'768 Hz for example. This reference signal is applied to a first frequency divider 36 which provides two output signals, the first of 8 Hz and the second of 1 Hz. An AND-gate 37 having two inputs receives on its first input the 1 Hz signal and supplies at its output a 1 Hz signal whenever its second input is at the high logic level. The output signal of AND-gate 37 is applied to a second frequency divider or seconds counter 38 having a return to zero input R and two outputs, the first providing a signal of 1/30 Hz and the second a signal of 1/60 Hz. These signals are formed by pulses, the first comprising two pulses per minute and the second one pulse per minute. The signal $C'_3$ from circuit 31 is applied to the input R of frequency divider 38 as well as the input of an inverter 39 of which the output is coupled to the second input of AND-gate 37.

When the watch is in the correction mode $C_3$, the signal $C'_3$ is at the high logic level. The output of inverter 39 is at the low logic level, this having as effect to block the gate 37 which will no longer pass the signal of 1 Hz coming from the frequency divider 36. The high logic level of the signal $C'_3$ thus resets to zero the frequency divider 38. The blocking of the signal of 1 Hz and the reset to zero of the frequency divider 38 by the signal $C'_3$ enable setting the time and having the watch start up exactly at a time signal by passing from the mode $C_3$ to the mode $F_2$, in which the signal $C'_3$ is at the low logic level, by drawing out crown 4.

The signal 1/30 Hz from the frequncy divider 38 is applied to the first input of a two input AND-gate 71. The second input of this gate is coupled to the output of an inverter 70 of which the input is controlled by the signal $C'_4$. When the watch is in the correction mode $C_4$, the inverted signal $C'_4$ being at the low level logic, AND-gate 71 blocks the 1/30 Hz signal.

Circuits 30, 31, 37, 39, 70 and 71 together form a circuit 200 which fulfils the mode selection functions and information correction of the watch.

A motor control circuit 40, having seven inputs and three outputs, receives on its first input the signal 1/30 Hz coming from the AND-gate 71 and on the second input the signal of 8 Hz from the first frequency divider 36. The three following inputs receive respectively the signals CD, SC1 and SC2, generated by the circuit 30. Finally, the two last inputs of circuit 40 are enabled by signals $C'_3$ and $C'_4$ produced by circuit 31. Signals $B_1$, $B_2$, $B_3$ appearing on the outputs of circuit 40, which will be described in detail further on, are applied to the two windings of a two-phase, bidirectional stepping motor 41. It is well understood that in modifying circuit 40 in a known manner, it might also be applied to a single-phase bidirectional motor. The motor 41 drives through gearing not shown, the hands 2 of the analog display of the watch. In the example given, each step of the motor 41 causes an advance of the hands of one half minute. It is evident that another ratio of reduction of the gearing would enable advancing the hands by 1/n minute at each step of the motor, this necessitating enabling the first input of the circuit 40 by a signal having a frequency n/60 Hz.

When the watch is operating in modes $F_1$, $F_2$, $F_3$, $C_1$ or $C_2$, each pulse of the 1/30 Hz signal causes the motor 41 to turn through one step always in the forward sense, i.e. causing the hands 2 to advance, whatever be the level of signal CD. In the correction mode $C_3$, the signal $C'_3$ being at the high logic level, circuit 40 becomes responsive to signal CD and the motor turns in the forward or reverse sense according to whether signal CD is at the low or high logic level. In the correction mode, the signal SC1 replaces, in circuit 40, the signal 1/30 Hz which is no longer present, since the 1 Hz signal is blocked by AND-gate 37. This permits rapidly advancing or turning back hands 2 by steps of ½ minute by turning crown 4 in one sense or the other. In the correction mode $C_4$ it is the signal $C'_4$ which is in the high level. This has an effect to block the signal 1/30 Hz by the AND-gate 71 and to no longer permit response of circuit 40 except to signal SC2. Each pulse of signal SC2 causes the generation, at the interior of circuit 40, of a second pulse which causes the motor 41 to make two steps quite close to one another in a manner such that the hands 2 give the impression of being displaced by integral minutes in one sense or the other. It will be understood that if each motor step causes the hands to advance by 1/n minute, the circuit 40 will have to generate by means well known to persons skilled in the art n-1 extra pulses in a manner to cause the hands to be displaced by an entire minute over a very short time period.

Following description of the circuits associated with the analog display, there will not be examined those which are associated with the digital display 3 comprising a first group of two alphanumerical characters, designated by X and a second group of two numerical characters designated by Y.

Referring again to FIG. 4 it is seen that the minute signal, that is to say, 1/60 Hz provided by the second frequency divider 38, is applied to the first input of a backward/forward counting circuit 42 having 6 inputs and 4 outputs. The second input receives signal CD of which the logic level determines the counting mode of circuit 42, forward when the level is low and backwards when high. The correction signal SC2 is applied to the third input. Finally, the three last inputs, taken in increasing order, receive respectively signals $C'_1$, $C'_2$ and $C'_3$.

The counting circuit 42 which will be described in detail hereinafter comprises four counters, the first for minutes, the second for hours, the third for days and the fourth for the date. In modes $F_1$, $F_2$ and $F_3$, circuit 42 counts minute pulses. The first counter then furnishes to the first output of the counting circuit 42 a multiple signal SM containing j binary signals the logic states of which define a number between 0 and 59 corresponding to the number of minutes elapsed since the start of the counting. In the same manner, the second counter furnishes to the second output a multiple signal SH giving the number of hours and the third counter a multiple signal SJ to the third output corresponding to the day of the week. Finally, the fourth counter provides the fourth output, with a multiple signal SD giving the date.

In the correction mode $C_1$ signal $C'_1$ is at the high logic level. This enables to add or subtract, in the third counter of the circuit 42, a predetermined number of pulses produced by the correction signal SC2 in order to correct the day of the week. In the same manner, in mode $C_2$, the signal SC2 enables correcting the date stored in the fourth counter. Finally, in mode $C_3$ the minute pulses being blocked, the correction signal is applied to the first input of circuit 42. This enables correction of the time of day indication, hours and minutes by steps of 1 minute through the first and the second counter.

The information items provided by the watch taken as example not being capable of simultaneous display, a selector circuit 43 shown on FIG. 4 is utilized to direct to display 3 the information items corresponding to each mode of operation of the watch.

Circuit 43 has ten inputs and two outputs. The first four inputs, taken in increasing order, receive respectively the multiple signals SM, SH, SJ and SD from circuit 42. The six following inputs, considered likewise in increasing order, receive respectively signals $F'_1$, $F'_2$, $C'_1$, $C'_2$, $C'_3$ and $C'_4$ from the circuit 31. The circuit 43 provides a multiple signal x (J; H) on its first output and a multiple signal y (D; M) on its second output. According to the mode in which the watch is placed the signal x is identical to the multiple signal SJ or to the multiple signal SH and the signal y to the multiple signal SH or to the multiple signal SM. Thus, for example, in mode $F_1$ the high logic level of signal $F'_1$ causes signal x to correspond to signal SJ and signal y to signal SD. In the same manner in the correction mode $C_3$, signal x contains the information of signal SH and signal y that of signal SM. In the mode $F_3$ it should be noted that circuit 43, no longer being controlled by the signal $F'_3$, signals x and y contain no information.

Signals x (J; H) and y (D; M) provided by the circuit 43 enable the inputs of a conventional decoder circuit 44 which controls in turn the digital display 3, employing for example liquid crystals. The characters X display the information items contained in signal x and the characters Y the information items contained in the signal y.

The circuits and components shown in the block schematic of FIG. 4 are of a conventional type and well known with the exception of circuits 30, 31, 40, 42 and 43. These latter fulfil functions specific to the present invention and they will now be described in detail.

Figure 5:
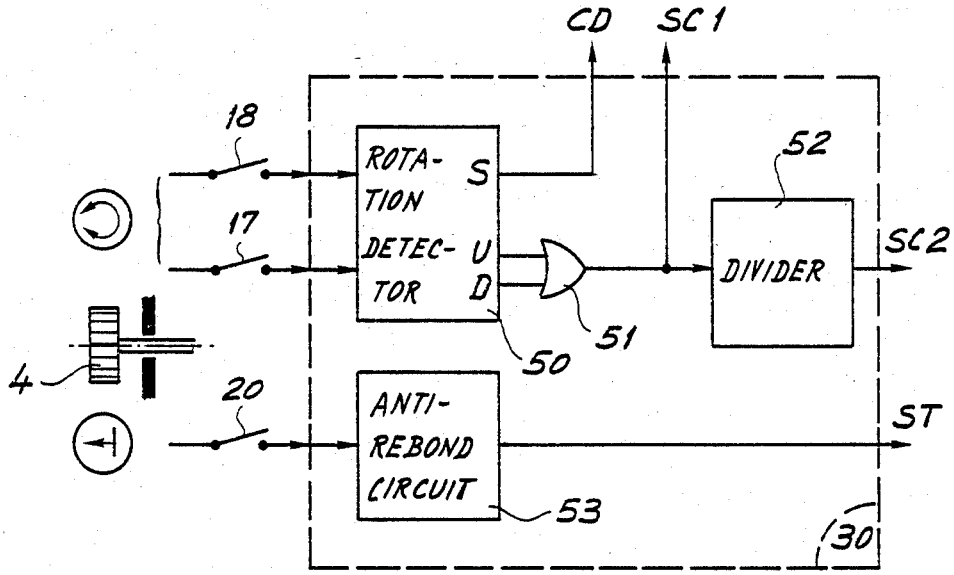
FIG. 5 shows an example of the movements encoder controlled by the detection contacts and which provides signals at its output representing movements of the crown.

The schematic of the encoder circuit 30 is shown on FIG. 5. It comprises a circuit 50 having two inputs and three outputs, an OR-gate 51 having two inputs, a divider-by-two 52 and a contact anti-rebound circuit 53. The first input of circuit 50 receives the signal coming from contact 17 and the second input that from contact 18. Output S of circuit 50 provides the signal CD of which the logic level depends on the sense of rotation of crown 4. The output U provides pulses when the crown turns in a first sense and no pulses when the crown turns in the opposite sense. Finally, the output D provides pulses when the crown turns in the second opposite sense and no pulses when it turns in the first sense. The number of pulses is proportional to the angle of rotation of the crown.

A circuit fulfilling the functions of circuit 50 of FIG. 5 has been described for example in Swiss patent No. 632 894 and in the corresponding U.S. Pat. No. 4,379,642. FIG. 3 of these documents gives the complete schematic of the circuit in which inputs 15 and 16 provided with anti-rebound circuits for the contacts, the output of AND-gate 41, the output of inverter 37 and the output of inverter 38 correspond respectively to the first and second inputs, the output S, the output U and the output D of the circuit 50 of the present application.

The outputs U and D of circuit 50 are coupled respectively to the first and second inputs of the OR-gate 51 which provides at its output the correction signal SC1. Signal SC1 provides, when circuit 50 is identical to that of the cited patent CH No. 632 894, a number of pulses equal to the number of openings and closings of contacts 17 and 18, i.e. 8 pulses for one rotation of 360° of crown 4. This signal is further applied to the divider-by-two 52 the output of which furnishes the correction signal SC2 containing one pulse out of two from signal SC1.

Finally, the anti-rebound circuit 53, as used in circuit 50, receives on its input the signal from contact 20 and supplies on its output a signal ST containing one pulse for each withdrawal of the crown 4.

Figure 6:
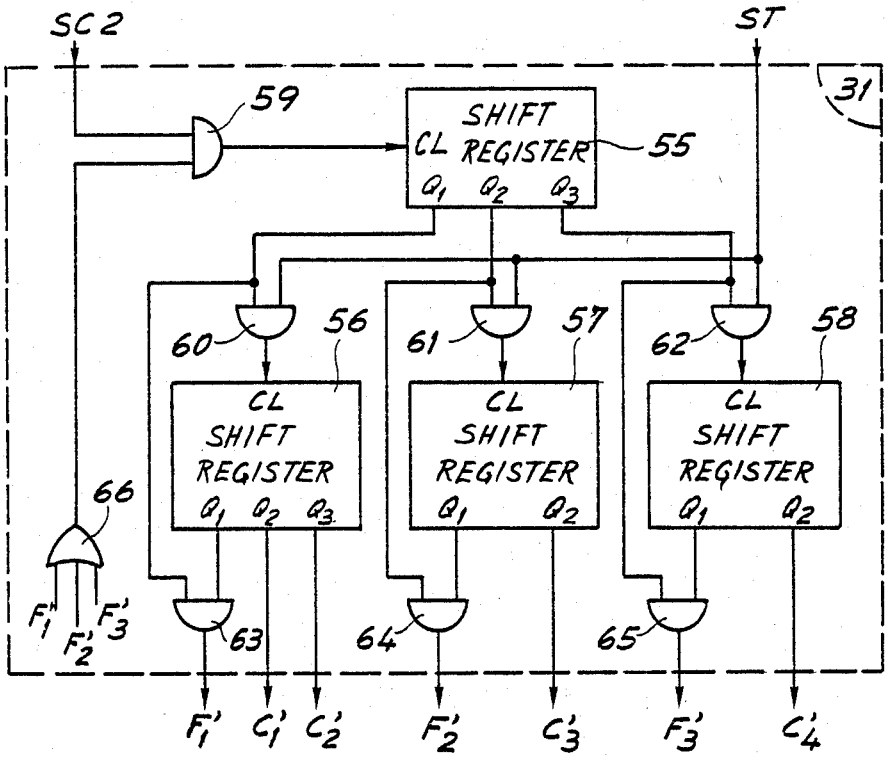
FIG. 6 represents an example of the mode selector circuit providing at its output signals representing the various operational modes of the watch in response to the signals representing movements of the crown.

FIG. 6 shows a schematic of a possible form of realization of the mode selector circuit 31. It comprises two shift registers 55 and 56 having three states, each with an input CL and three outputs $Q_1$, $Q_2$ and $Q_3$, two shift registers of two states 57 and 58 each with an input CL and two outputs $Q_1$ and $Q_2$, seven two input AND-gates referenced 59 to 65 and an OR-gate 66 having three inputs.

The output $Q_1$ of register 55 is coupled to the first inputs of AND-gates 60 and 63. The output $Q_2$ of the same register is coupled to the first inputs of AND-gates 61 and 64. Finally, the output $Q_3$ is coupled to the first inputs of AND-gates 62 and 65. The second inputs of the AND-gates 60 and 62 receive the signal ST. The second inputs of AND-gates 63, 64 and 65 are respectively coupled to the outputs $Q_1$ of registers 56, 57 and 58. The outputs of AND-gates 60, 61 and 62 are coupled respectively to inputs CL of registers 56, 57 and 58. The outputs of AND-gates 63, 64 and 65 respectively furnish signals $F'_1$, $F'_2$ and $F'_3$. The outputs $Q_2$ and $Q_3$ of the register 56 provide respectively the signals $C'_1$ and $C'_2$. In the same manner, outputs $Q_2$ of registers 57 and 58 provide respectively the signals $C'_3$ and $C'_4$. The first input of AND-gate 59 receives the signal SC2, but the signal SC1 might equally be used in the place of signal SC2. The output of AND-gate 59 is applied to the input CL of the register 55. Finally, the second input of AND-gate 59 receives the output signal from the OR-gate 66 of which the three inputs receive the signals $F'_1$, $F'_2$ and $F'_3$.

The operation of the circuit of FIG. 6 will now be described. Let us suppose that in the initial state established just after the placing under tension of the watch circuits the registers 55 to 58 are all set, by known means not shown, in a state where only outputs $Q_1$ are at the high logic level. In these conditions a high logic level appears at the first input of AND-gates 60, 64, 65 and on both inputs of the AND-gate 63. At the output of this latter gate the signal $F'_1$ will be then at the high logic level while the other output signals $F'_2$, $F'_3$, $C'_1$, $C'_2$, $C'_3$ and $C'_4$ are at the low logic level. The high logic level of the signal $F'_1$ applied to the input of the OR-gate 66 provides that the second input of AND-gate 59 will be likewise at a high logic level. A first pulse of the signal SC2 may then pass through this last gate to be applied to the input CL of shift register 55, thus to transform the output $Q_1$ thereof to the low logic level and output $Q_2$ to the high logic level. The first input of AND-gate 63 going to the low logic output transforms in a like manner the signal $F'_1$ on its output. On the other hand both inputs of AND-gate 64 are now at the high logic level and the signal $F'_2$ at the output thereof likewise exhibits the same logic state. The first pulse from signal SC2 thus causes signal $F'_1$ to pass to the low logic level and the signal $F'_2$ to the high logic level. Signal $F'_2$ being also applied to the input of the OR-gate 66 the second input of AND-gate 59 continues at the high logic level. A second pulse of the signal SC2 may thus attain the input CL of register 55 to cause its output $Q_2$ to pass to the low logic level and its output $Q_3$ to the high logic level. The first input of AND-gate 64 being now at the low logic level, the signal $F'_2$ on its output goes to the same logic state. The two inputs of AND-gate 65 being now at the high logic level the output $F'_3$ thereof goes to the same logic state. The second pulse of signal SC2 thus causes the signal $F'_2$ to drop to the low logic level and the signal $F'_3$ to go to the high logic level. A similar analysis shows that a third pulse of the signal SC2 will cause the circuit to revert to its initial state in which only the signal $F'_1$ is at the high logic level.

Let us now examine the effect of a first pulse from the signal ST on the circuit of FIG. 6 when it is in its initial state. The first input of AND-gate 60 being then at the high logic level, it passes a pulse of the signal ST to the input CL of register 56. This causes the output $Q_1$ thereof and consequently signal $F'_1$ to go to the low logic level and output $Q_2$ thus signal $C'_1$ to the high logic level. The first pulse of signal ST has thus switched the watch circuit from the function $F_1$ to the correction mode $C_1$. A second pulse of the signal ST for the same reason will switch the output $Q_2$ of the register 56 thus signal $C'_1$ to the low logic level and the output $Q_3$ thus signal $C'_2$ to the high logic level. After the first and the second pulses of signal ST signals $F'_1$, $F'_2$ and $F'_3$ being now at the low logic level, the second input of AND-gate 59 will be likewise at the low logic level. In the correction modes $C_1$ and $C_2$ AND-gate 59 therefore blocks the pulses of signal SC2. A third pulse of signal ST restores the circuit to its initial state with a high logic level at the output $Q_1$ of register 56. A similar analysis will show that signals $C'_3$ and $F'_2$ pass successively to the high level at each pulse of signal ST with a high logic level at the output $Q_2$ of shift register 55. Finally, if output $Q_3$ of this register is at the high logic level it is the signal $C'_4$ and $F'_3$ which will successively exhibit the high logic level at each pulse of signal ST. In the correction modes the pulses of signal SC2 have no effect on the circuit.

Figure 7:
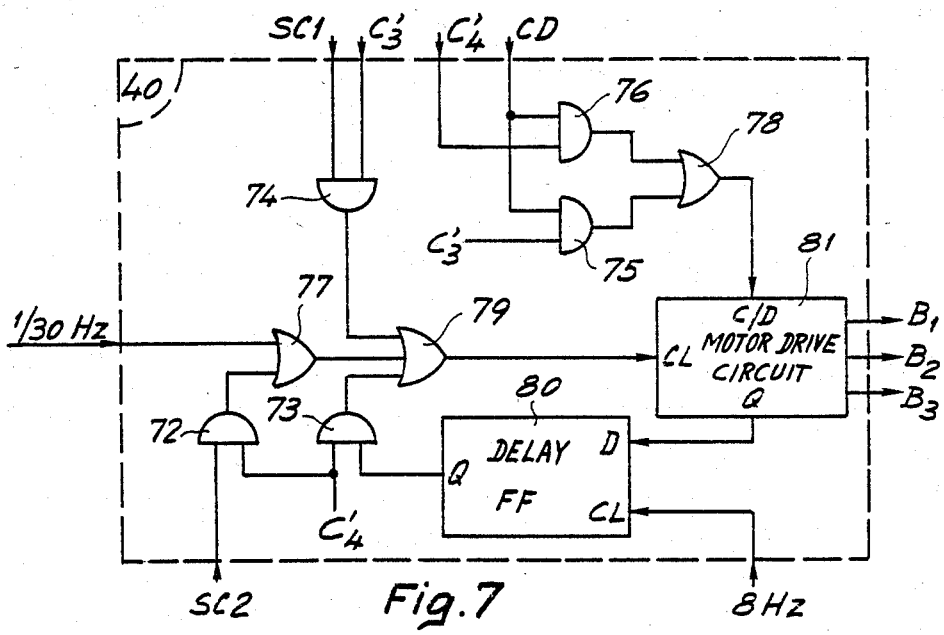
FIG. 7 shows an example of a control circuit of a two-phase bidirectional stepping motor.

On FIG. 7 is shown the schematic of a possible form of realization of control circuit 40 of motor 41. This circuit comprises five AND-gates referenced 72 to 76, each having two inputs, two OR-gates referenced 77 and 78, having two inputs, an OR-gate 79 with three inputs, a delay monostable 80 having two inputs CL and D and an output Q and finally a motor drive circuit 81 having two inputs CL and C/D and four outputs Q, $B_1$, $B_2$ and $B_3$.

The signal 1/30 Hz from the output of AND-gate 71 (FIG. 4) is applied to the first input of OR-gate 77 and the second input of this latter receives the signal provided by the output of AND-gate 72. The first inputs of AND-gates 72 and 73 are coupled together and enabled by signal $C'_4$. The second input of AND-gate 72 receives signal SC2. The second input of AND-gate 73 is coupled to the output Q of monostable 80. The first and the second inputs of AND-gate 74 receive respectively signals SC1 and $C'_3$. The output of this latter gate is coupled to the first input of OR-gate 79. The output of OR-gate 77 and the output of AND-gate 73 are respectively coupled to the second and the third inputs of the OR-gate 79. The output of this latter is coupled to the input CL of motor drive circuit 81. The first inputs of AND-gates 75 and 76 receive the signal CD generated by circuit 30 (FIG. 4, 5). The second inputs of these latter gates receive respectively signals $C'_3$ and $C'_4$. The first and second inputs of OR-gate 78 are respectively coupled to the outputs of AND-gates 75 and 76. The input C/D of motor drive circuit 81 is connected to the output of the OR-gate 78 and the output Q of the same circuit is coupled to the input D of monostable 80. Finally, the input CL of monostable 80 receives the 8 Hz signal coming from the frequency divider 36 but any signal having a frequency of the same order of magnitude could also be employed.

The motor drive circuit 81 shown on FIG. 7 provides signals $B_1$, $B_2$, $B_3$ to the two series-connected windings of the two-phase motor 41 in a manner to cause it to turn through one step responsive to each pulse applied to the input CL. The signal $B_1$ is applied to a terminal of the first winding, the signal $B_2$ to a terminal of the second winding and the signal $B_3$ to the terminal common to both windings. One step of the motor corresponds to a rotation of 180° of the rotor and causes the minutes hand to advance the analog display through ½ minute. The rotor may thus occupy two positions and to each position corresponds a logic state of the output Q. The rotation is effected in one sense or the other in accordance with the logic state of the input C/D. It will be supposed that the motor turns in the sense which causes the hands 2 to advance whenever the terminal C/D is at the low logic level.

Such a circuit has been described in detail in the Swiss patent application No. 918/82-8 corresponding to European specification No. 0087 387 laid open Aug. 31, 1983 or U.S. application Ser. No. 466,392 filed Feb. 14, 1983, and FIG. 5 of this document gives an example of the schematic. In the schematic $C_k$ and Q of the bistable 34 and AR at the input of the inverter 29 correspond respectively to CL, Q and C/D of the circuit 81 of the present application. The signal on the point common to the two transistors $T_5$ and $T_6$ of the cited application corresponds to the signal $B_1$ of the present application. In the same manner, the signal on the point common to the transistors $T_1$ and $T_2$ corresponds to signal $B_2$ and that of the point common to the transistors $T_3$ and $T_4$ to the signal $B_3$.

In the operation of the circuit 40 represented on FIG. 7 it is necessary to distinguish three cases. The first is that when signals $C'_3$ and $C'_4$ are at the low logic level thus effecting the same logic state on the two inputs of AND-gates 72 to 76 hence at the output of each of these gates. This blocks signals SC1, SC2 as well as the output signal Q of the monostable 80 respectively by AND-gates 74, 72 and 73 and effects a low logic level on the input C/D of the motor drive circuit 81 via AND-gates 75, 76 and OR-gate 78. The low logic level of signal $C'_4$ causes a high logic level to appear at the output of inverter 70 (FIG. 4) as well as on the second input of the AND-gate 71 which enables transmitting the signal of 1/30 Hz present on the first input. This signal passes through the OR-gates 77 and 79, the other inputs being all at the low logic level and thereby enables the input CL of circuit 81. In the first case of the operation of circuit 40 the input C/D of the circuit 81 is thus at the low logic level and the 1/30 Hz signal controls directly the input CL.

The second case is that where the signal $C'_3$ is at the high logic level and the signal $C'_4$ at the low logic level. The second inputs of AND-gates 74 and 75 are then at the high logic level, permitting the signal SC1 to arrive at the first input of OR-gate 79 and the signal CD at the input C/D of the circuit 81 via OR-gate 78. The 1 Hz signal being blocked by the AND-gate 37 (FIG. 4), the 1/30 Hz signal no longer exists and only the signal SC1 arrives through OR-gate 79 to the input CL of the motor drive circuit 81 enabling correction of the analog display in the forward or backward sense.

Finally, in the third case, the signal $C'_3$ is at the low level logic state and the signal $C'_4$ at the high logic state. This brings about a low logic level on the second input of AND-gates 71 (FIG. 4) and 74 and a high logic level on the first input of AND-gates 72, 73 and on the second input of the AND-gate 76. There results therefrom that the 1/30 Hz signals and SC1 are blocked while the signal SC2 arrives at the second input of OR-gate 77, that the signal at the output Q of monostable 80 reaches the third input of the OR-gate 79 and finally that the signal CD arrives at the input C/D of motor drive circuit 81. Signal SC2 arrives thus at the input CL of circuit 81 through OR-gates 77 and 79 and the output signal Q of the monostable 80 arrives on the same input through OR-gate 79. It will be supposed that the output Q of the circuit 81 is at the low logic level if the minutes hand is positioned on a minute indication and at the high logic level if this hand is between two minute indications. The logic level of the output Q of circuit 81 applied to the input D of the monostable 80 will arrive at the output Q thereof after a half period of the 8 Hz signal applied to its input CL, or 1/16 of a second later.

Let us now suppose, always in the third case, that at the moment of passage of signal $C'_4$ from the low logic level to the high logic level, the minutes hand is not on a minute division and that the output Q of the monostable 80 is already at the high logic level. The transmission of signal $C'_4$, through AND-gate 73 and OR-gate 79 will enable the input CL of circuit 81 and cause the motor 41 to advance through one step. The minutes hand will then be positioned on a minute, the output Q of the motor drive circuit 81 will pass to the low logic level and 1/16 of a second later, the output Q of the monostable 80 will assume the same logic state. On the other hand, if the minutes hand is already on a whole minute division and the output Q of the monostable 80 at the low logic level at the moment when the signal $C'_4$ goes to the high logic level no pulse will appear on the input CL of circuit 81 and the motor 41 will remain stopped in the rest position. Thus the passage to the correction mode $C_4$ has as effect to place the minutes hand on a minute division if it does not already occupy such position.

Finally, let us examine the effect of a pulse of signal SC2 when the watch is in the correction mode $C_4$. The minutes hand being already positioned on a minute division, a pulse of signal SC2 will cause a first step of the motor 41 forwards or backwards in accordance with the rotation sense of the crown 4. At the same time, the output Q of the circuit 81 goes to the low logic level and 1/16 of a second later, the output Q of monostable 80 assumes the same logic state. The transmission of the output of this monostable will cause the motor to advance a second step, bringing the minutes hand onto a minute division. Thus each pulse of signal SC2 has as effect to cause the motor to make two very closely spaced steps in succession, giving the impression that the minutes hand advances or returns by entire minute steps.

Figure 8:
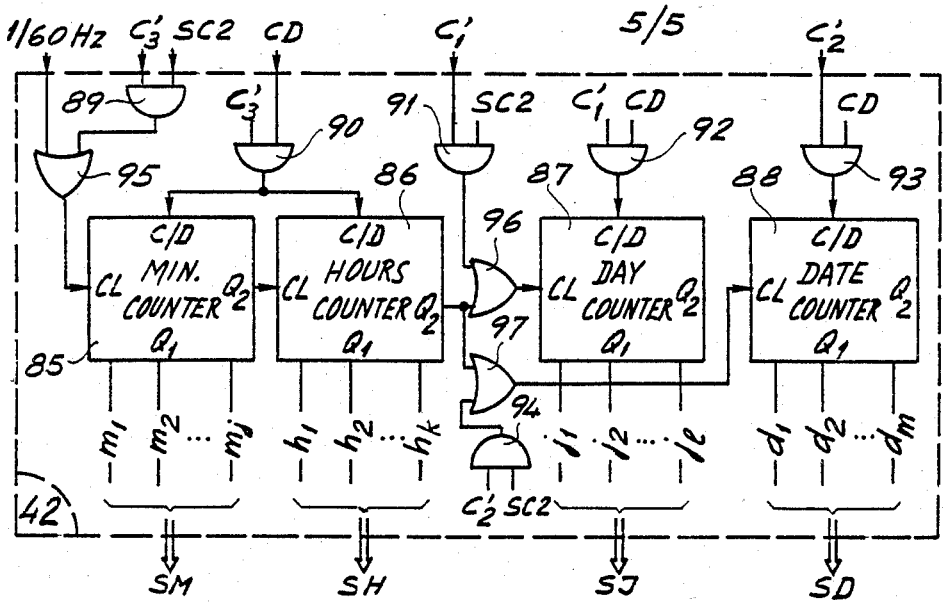
FIG. 8 represents an example of a counting circuit.

FIG. 8 shows a possible form of realization of the counting circuit 42. This circuit comprises a minutes counter 85, an hours counter 86, a day counter 87 and a date counter 88, each counter having two inputs CL and C/D, and two outputs $Q_1$ and $Q_2$, six two input AND-gates referenced 89 to 94 and three two input OR-gates referenced 95 to 97.

The inputs CL of counters 85 to 88 receive counting pulses, the sense of the counting being determined by the logic level of the input C/D. It will be assumed that the contents of a counter is increased by each counting pulse if C/D is at the low logic level and decreased in the contrary case. Output Q1 of the counters is multiple and provides the number of binary signals necessary to define the maximum contents of each respective counter. Thus, the output $Q_1$ of the minutes counter 85 provides $m_1, m_2, \ldots m_j$ binary signals, so as to enable defining any number comprised between 0 and 59. It will be seen immediately that in this case $j=6$ and that the collection of signals $m_1, m_2, \ldots m_j$ defines the multiple minutes signal SM. In an analogous fashion, the output $Q_1$ of the hours counter 86 provides $h_1, h_2, \ldots h_k$ binary signals defining a number comprised between 1 and 12 or between 1 and 24, the collection of these signals providing the multiple hours signal SH. Output $Q_1$ of the days counter 87 provides $j_1, j_2 \ldots j_l$ binary signals defining a number comprised between 1 and 7, each number corresponding to a week day. The collection of these signals thus forms the multiple days signal SJ. Finally, the output $Q_1$ of the date counter 88 provides $d_1, d_2, \ldots d_m$ binary signals defining a number between 1 and 31, the collection of these signals providing the multiple date signal SD. Once a counter is entirely filled, it will generate a pulse on its output $Q_2$.

The first input of OR-gate 95 receives the signal 1/60 Hz from the frequency divider 38 and the second input of this gate is coupled to the output of the AND-gate 89. The first input of AND-gate 89 receives signal $C'_3$ and the second input thereof receives the correction signal SC2. The inputs C/D of counters 85 and 86 are coupled to the output of AND-gate 90 which receives on its first input the signal $C'_3$ and on its second input the signal CD. The output $Q_2$ of counter 85 is coupled to the input CL of counter 86 the output $Q_2$ of which is coupled to the first input of OR-gates 96 and 97. The second input of the OR-gate 96 is coupled to the output of the AND-gate 91 which receives on its first input the signal $C'_1$ and on its second input the correction signal SC2. The second input of the OR-gate 97 is coupled to the output of the AND-gate 94 which receives on its first input signal $C'_2$ and on its second input correction signal SC2. The output of OR-gate 96 is coupled to the input CL of counter 87 the output $Q_2$ of which remains free. The output of OR-gate 97 is coupled to the input CL of counter 88 of which the output $Q_2$ is likewise free. The input C/D of the counter 87 is coupled to the AND-gate 92 which receives on its first input signal $C'_1$ and on its second input signal CD. Finally, the input C/D of counter 88 is coupled to the output of AND-gate 93 which receives on its first input signal $C'_2$ and on its second input signal CD.

In the operation of circuit 42 shown on FIG. 8 four cases are to be distinguished. The first corresponds to that in which signals $C'_1$, $C'_2$ and $C'_3$ are all at the low logic level. The three others correspond to the case where one of the signals $C'_1$, $C'_2$ or $C'_3$ is to be found at the high logic level.

The low logic level of signals $C'_1$, $C'_2$ and $C'_3$ in the first case brings about a low logic level on the first input of AND-gates 89 to 94. Thus an equally low logic level appears at the outputs of these gates whatever be the logic level of the second input. There results therefrom a low logic level on the input C/D of counters 85 to 88. Each counting pulse on the input CL thus increases their contents. The second input of OR-gates 95 to 97 are likewise at a low logic level. These gates thus transmit only the signal present on their first input. Thus only the minutes signal 1/60 Hz arrives via the OR-gate 95, at the input CL of minutes counter 85. The contents of this counter appear at the output $Q_1$ while at the output $Q_2$ appears a one pulse signal each hour, this being applied to input CL of hours counter 86. The contents of the counter 86 appear at its output $Q_1$ while the output $Q_2$ provides a one pulse signal each 24 hours. This latter signal is applied via the OR-gates 96 and 97 to the inputs CL of days counter 87 and date counter 88. The contents of these counters appear at their respective outputs $Q_1$. In the first case circuit 42 thus simply counts the minutes pulses and provides information relative to the hour, the day and the date.

The second case is that wherein the signal $C'_1$ is at the high logic level and signals $C'_2$ and $C'_3$ at the low logic level. The first input of AND-gates 91 and 92 being then at the high logic level, at the output of these gates appear respectively signals SC2 and CD. Signal SC2 then arrives via OR-gate 96 at the input CL of day counter 87 and the signal CD at the input C/D of the same counter. The pulses of signal SC2 generated by rotation of the crown 4 thus effect modification by addition or subtraction of the contents of the days counter according to the rotation sense.

In the third case, it is signal $C'_2$ which is at the high logic level and signals $C'_1$ and $C'_3$ at the low logic level. This case is similar to the preceding cases. The first input of AND-gates 93 and 94 being at the high logic level, signal SC2 arrives via the OR-gate 97 at input CL of date counter 88 and signal CD on input C/D of the same counter. The rotation of the crown 4 then permits modification of the contents of this counter.

Finally, in the fourth case of operation of circuit 42, signal $C'_3$ is at the high logic level and signals $C'_1$ and $C'_2$ at the low logic level. The first input of AND-gates 89 and 90 being at the high logic level, the signal SC2 arrives at the input CL at the minutes counter 85 via OR-gate 95 and signal CD at input C/D of counters 85 and 86. The pulses of signal SC2 in response to the rotation of the crown 4 then enable correction of the time information by modifying the contents of counters 85 and 86.

Figure 9:
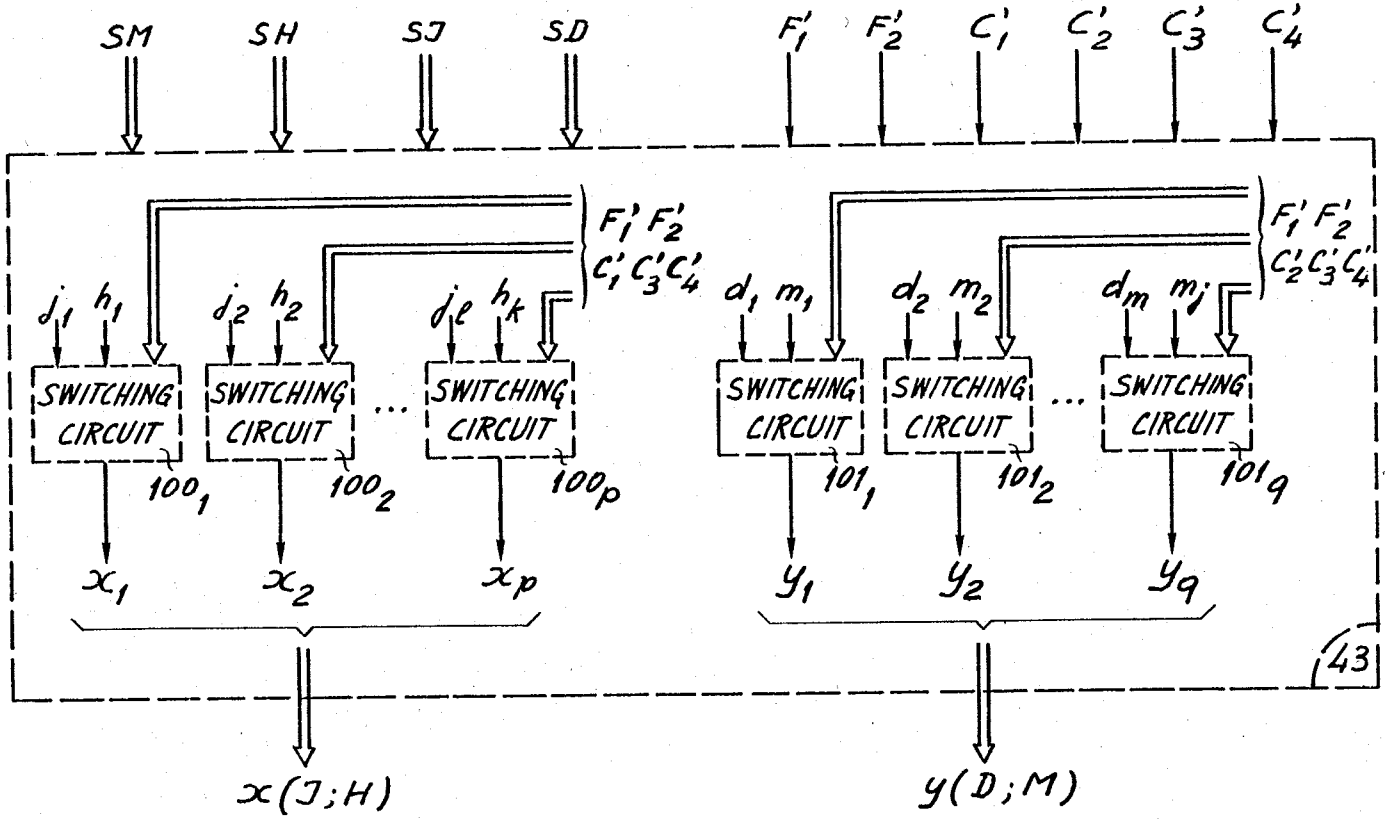
FIG. 9 shows an example of a selecting circuit for the displays and finally

A possible form of the schematic of the display selecting circuit 43 is shown on FIG. 9. This circuit comprises p switching circuits all identical referenced $\mathbf{100}_1$, $\mathbf{100}_2$, . . . $\mathbf{100}_p$ and q switching circuits likewise identical, referenced $\mathbf{101}_1$, $\mathbf{101}_2$, . . . $\mathbf{101}_q$. These circuits each have seven inputs and one output and will be described in detail hereinafter. The circuit $\mathbf{100}_1$ receives on its first input signal $j_1$ contained in the multiple signal SJ provided by circuit 42 (FIG. 8), on its second input signal $h_1$ contained in multiple signal SH, on the 5 inputs following, taken in increasing order, respectively control signals $F'_1$, $F'_2$, $C'_1$, $C'_3$, $C'_4$ and it provides on its output signal $x_1$. Circuit $\mathbf{100}_2$ receives on its first two inputs signals $j_2$ and $h_2$, on the other inputs the same control signals as circuit $\mathbf{100}_1$ and it provides on its output signal $x_2$. Finally, circuit $\mathbf{100}_p$, p being equal to the higher of the two numbers 1 or k, receives on its two inputs signals $j_1$ and $h_k$, on its other inputs the same signals as circuit $\mathbf{100}_1$ and provides on its output signal $x_p$. If for example 1 is greater than k, then p=1 and signals $h_{k+1}$ to $h_p$ not existing, the second inputs of circuit $\mathbf{100}_{k+1}$ to $\mathbf{100}_p$ will be all placed in the low logic level. Signals $x_1$, $x_2$ . . . $x_p$ of this circuit define the multiple signal x (J; H). In an analogous manner, circuit $\mathbf{101}_1$ receives on its first input signal $d_1$, on its second input signal $m_1$, on the five following inputs respectively control signals $F'_1$, $F'_2$, $C'_2$, $C'_3$, $C'_4$ and it provides on its output signal $y_1$. Finally, for circuit $\mathbf{101}_q$ there may be said exactly the same thing as for circuit $\mathbf{100}_p$ conditioned on replacing j by d, h by m, index 1 by n, index k by j and index p by q. Signals $y_1$, $y_2$ . . . $y_q$ of these circuits define the multiple signal y (D; M).

According to the logic state of the control signals $F'_1$, $F'_2$, $C'_1$, $C'_3$, $C'_4$, the selection circuits $\mathbf{100}_1$ to $\mathbf{100}_p$ will transmit on their respective output either the signals $j_1$ . . . $j_1$ or signals $h_1$ . . . $h_k$. Thus in the case where one of these signals $F'_1$ or $C'_1$ is at the high logic level and the other control signals at the low logic level, the signal $x_1$ will be identical to the signal $j_1$, the signal $x_2$ to the signal $j_2$ etc. and finally the signal x (J; H) will be identical to signal SJ. On the other hand, if it is one of the signals $F'_2$, $C'_3$, $C'_4$ which is at the high logic level, with the other control signals at the low logic level, the output signal x (J; H) will be identical to signal SH. Selection circuits $\mathbf{101}_1$ to $\mathbf{101}_q$ function in a like manner. If one of the signals $F'_1$ or $C'_2$ is at the high logic level and the other control signals at the low logic level the output signal $y_1$ will be identical to the signal $d_1$, signal $y_2$ to signal $d_2$ etc. and finally signal y (D; M) will be identical to signal SD. Finally, if it is one of the signals $F'_2$, $C'_3$, $C'_4$ which is at the high logic level and the other control signals at the low logic level, signal y (D; M) will be identical to signal SM.

Figure 10A:
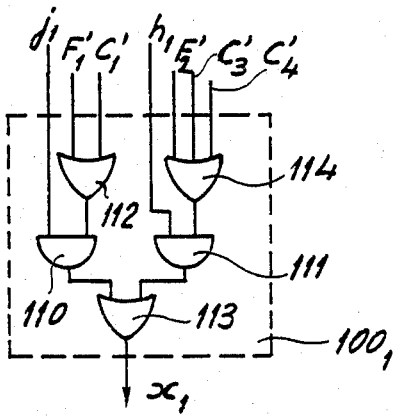
FIGS. 10*a* and 10*b* give an example of switching circuits employed in the selector circuit.

A practical example of switching circuit $\mathbf{100}_1$ is represented on FIG. 10*a*. This circuit comprises two AND-gates 110 and 111 having two inputs, two OR-gates 112 and 113 with two inputs and an OR-gate 114 with three inputs. The first input of the AND-gate 110 receives signal $j_1$ and the second input of this gate is coupled to the output of OR-gate 112. The first input of OR-gate 112 receives signal $F'_1$ and the second input thereof receives signal $C'_1$. The first input of AND-gate 111 receives signal $h_1$ and the second input thereof is coupled to the output of OR-gate 114. The three inputs of OR-gate 114, taken in increasing order, receive respectively signals $F'_2$, $C'_3$ and $C'_4$. Finally, signal $x_1$ appears at the output of OR-gate 113 one input of which is coupled to the output of AND-gate 110 and the other input to the output of AND-gate 111.

The operation of the switching circuit $\mathbf{100}_1$ of FIG. $\mathbf{10}_a$ is as follows. If one of the signals $F'_1$ or $C'_1$ is at the high logic level and the other control signals $F'_2$, $C'_3$, $C'_4$ at the low logic level, the output of OR-gate 112 will be at the high logic level and the output of the OR-gate 114 at the low logic level. The second input of AND-gate 111 being at the low logic level, this gate blocks signal $h_1$ applied to its first input. The second input of AND-gate 110 being on the other hand at the high logic level allows passage of the signal $j_1$ which will be transmitted to the output of OR-gate 113. The signal $x_1$ is thus identical in this case to signal $j_1$. If now one of the signals $F'_2$, $C'_3$, $C'_4$ is at the high logic level and the other control signals $F'_1$, $C'_1$ at the low logic level, then the output of OR-gate 112 will be at the low logic level and the output of the OR-gate 114 at the high logic level. In this case it is the signal $j_1$ which is blocked and the signal $x_1$ becomes identical to signal $h_1$.

Figure 10B:
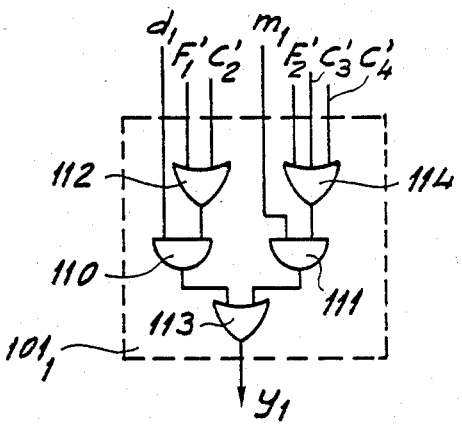

The structure of the switching circuit $\mathbf{101}_1$ represented on FIG. 10*b* is identical to that of circuit $\mathbf{100}_1$, the two circuits comprising the same gates interconnected in the same manner. On the other hand, in the circuit $\mathbf{101}_1$, the first input of AND-gate 110 receives signal $d_1$ in place of $j_1$, the first input of AND-gate 111 receives signal $m_1$ in place of $h_1$ and the second input of OR-gate 112 receives signal $C'_2$ in place of $C'_1$. The other inputs of the OR-gates 112 and 114 are the same in both circuits.

The operation of circuit $\mathbf{101}_1$ of FIG. 10*b* is thus similar to that of circuit $\mathbf{100}_1$. Taking into account the fact that different signals are applied on certain inputs of the circuits $\mathbf{100}_1$ and $\mathbf{101}_1$, signal $y_1$ will be identical to the signal $d_1$ if one of the signals $F'_1$ or $C'_2$ is at the high logic level and the other control signals at the low logic level. In the same manner, the signal $y_1$ will be identical to the signal $m_1$ if it is one of the signals $F'_2$, $C'_3$, $C'_4$ which is at the high logic level and the other control signals at the low logic level.

This invention is not limited to the precise example which has just been described. For instance, the hands of the analog display could be replaced by discs bearing reference marks. In the same manner, the digital display could be obtained through the use of light-emitting diodes, electro-chromic means, etc. in place of liquid crystals. The crown could also have more than two axial positions in order to increase the control possibilities. Other control means e.g. push-buttons operating on the contacts, capacitive keys, photoelectric sensors, etc. could be used in the place of a crown or together therewith. The correction pulses could be taken from the frequency divider. The digital display could have a seconds indication. In such case the watch might comprise means permitting the alignment of the minutes hand on the seconds, preferably automatically whenever one left the synchronization mode. The digital display and the analog display might both display seconds and in this case the synchronization mode could be limited to aligning the seconds hand on the seconds of the digital display. A further synchronization mode could be provided in order to permit additionally separate alignment of the hours hand with the hours of the digital display. Many other variations are possible.

What I claim is:

1. An electronic watch comprising a time base arranged to provide a standard frequency signal;

indicating means arranged to display a first group of time information items in analog form, one of said indicating means being a minutes indicator;

a stepping motor mechanically coupled to said indicating means;

a control circuit arranged to supply drive pulses to the motor so as to effect displacement of said indicating means in response to time pulses provided by the divider circuit as well as to correcting pulses;

a counting circuit likewise receiving time pulses from the divider circuit thereby to provide signals representing a second group of time information items of which at least one information item is included in said first group;

an electro-optic display coupled to said counting circuit in order to display the second group of time information in digital form;

manual control means; and a selecting and correcting logic circuit responsive to operation of said manual control means thereby to place the watch in different display modes for each of which a selected time information is displayed by said electro-optic display means, in different correction modes for each of which a displayed information item may be corrected through application by said logic circuit of correcting pulses to the counting circuit, said logic circuit likewise applying correcting pulses to the motor control circuit whenever the information to be corrected is common information to both groups, said common information being the minutes information and said minutes indicator normally advancing by n steps per minute, n being at all times greater than 1, in a manner to modify the analog and digital indications of said common information by the same quantity, and in a supplementary synchronization mode in which said common information is displayed by said electro-optic digital display and in which said logic circuit responds to an operation of the manual control means by applying correcting pulses only to the motor control circuit in order to enable bringing the analog indication into coincidence with the digital indication of said information, wherein the motor control circuit is adapted to bring said minutes indicator automatically to an integral minute indication at the moment of switching to the synchronization mode and in said mode to generate and to apply n successive drive pulses to the motor in response to each correcting pulse which said motor control circuit receives from the logic circuit.

2. An electronic watch as set forth in claim 1 wherein said logic circuit comprises means for preventing application of time pulses to the motor control circuit when in the synchronisation mode.

3. An electronic watch as set forth in claim 1 wherein n equals 2.

4. An electronic watch as set forth in claim 1 wherein said first and second groups include a further common information item comprising the hours indication.

5. An electronic watch as set forth in claim 1 in which said stepping motor comprises a bi-directional motor and wherein the counting means is adapted to count up and down whereby the time information of both groups may be modified in both senses.

6. An electronic watch as set forth in claim 1 wherein the manual control means comprises a rotatable crown adapted to be axially displaced between at least two positions thereby to operate electric contacts coupled to said logic circuit.

* * * * *